US010593243B2

(12) United States Patent
Chang et al.

(10) Patent No.: US 10,593,243 B2
(45) Date of Patent: Mar. 17, 2020

(54) DISPLAY DRIVER, DISPLAY APPARATUS, AND OPERATIVE METHOD THEREOF FOR REMEDYING MURA EFFECT AND NON-UNIFORMITY

(71) Applicant: Novatek Microelectronics Corp., Hsinchu (TW)

(72) Inventors: Chia-Wei Chang, Hsinchu County (TW); Jen-Hao Liao, Hsinchu County (TW); Po-Chuan Chang-Chian, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 45 days.

(21) Appl. No.: 15/973,493

(22) Filed: May 7, 2018

(65) Prior Publication Data

US 2019/0340965 A1 Nov. 7, 2019

(51) Int. Cl.
*G09G 3/00* (2006.01)
*G09G 3/3233* (2016.01)

(52) U.S. Cl.
CPC ..... *G09G 3/006* (2013.01); *G09G 3/3233* (2013.01); *G09G 2320/0233* (2013.01); *G09G 2320/0276* (2013.01); *G09G 2330/02* (2013.01); *G09G 2330/12* (2013.01)

(58) Field of Classification Search
CPC ..... G09G 3/006; G09G 3/3233; G09G 2320/0233; G09G 2330/12; G09G 2320/0276; G09G 2330/02
See application file for complete search history.

(56) References Cited

U.S. PATENT DOCUMENTS

| | | | | |
|---|---|---|---|---|
| 8,624,805 | B2 | 1/2014 | McCreary | |
| 2006/0087247 | A1* | 4/2006 | Malmberg | G09G 3/006 315/169.2 |

* cited by examiner

*Primary Examiner* — Rodney Amadiz
(74) *Attorney, Agent, or Firm* — JCIPRNET

(57) ABSTRACT

A display apparatus including a display panel, a display driver, a controller and an external circuit is introduced. The display drive includes a power circuit that supplies a first voltage and a second voltage to the display panel to sense a plurality of sensing currents flowing through the display panel according to the first voltage and the second voltage in a first operating mode. The display driver receives the plurality of sensing currents and a target current from the display panel in the first operating mode. The controller is coupled to the display driver and configured to determine a plurality of offsets according to the plurality of sensing currents and the target current in the first operating mode. The external memory is coupled to the controller and the display driver to store the offsets in the first operating mode. The display driver and a method adapted to a display apparatus are also introduced.

17 Claims, 8 Drawing Sheets

Block Current–Gamma Code Curve
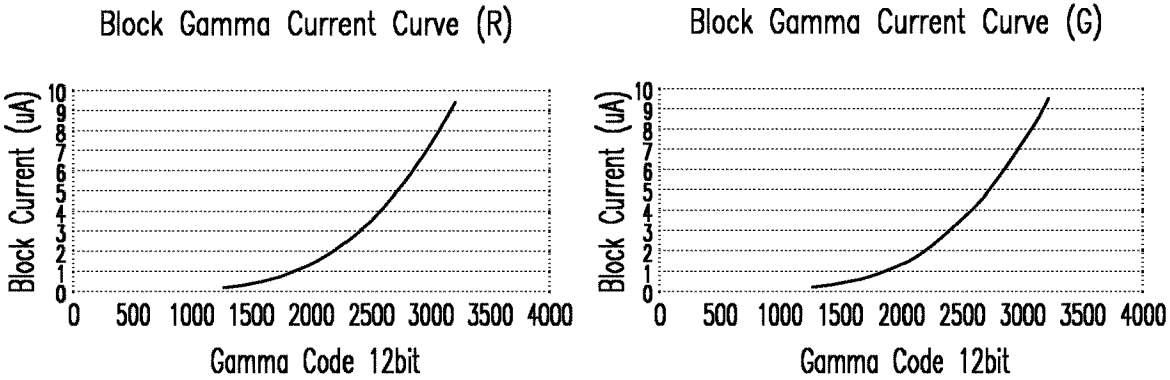
FIG. 7A
FIG. 7B
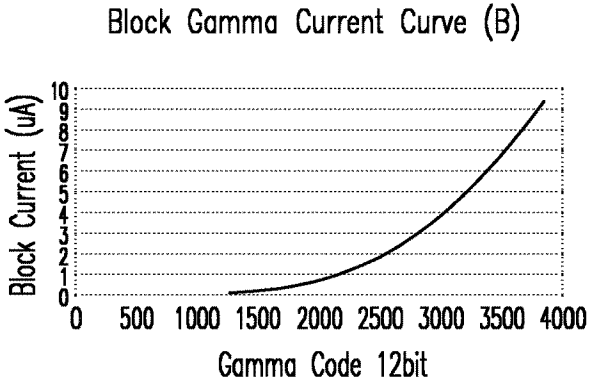
FIG. 7C

DISPLAY DRIVER, DISPLAY APPARATUS, AND OPERATIVE METHOD THEREOF FOR REMEDYING MURA EFFECT AND NON-UNIFORMITY

BACKGROUND

Technical Field

The disclosure generally relates to a display driver, a display apparatus, and an operative method thereof, and more particularly relates to display driver, a display apparatus, and an operative method of that are capable of remedying Mura effect and non-uniformity in a display panel.

Description of Related Art

Display panels, and especially active matrix organic light-emitting diode (AMOLED) displays, are applied widely in the real-life applications and electronic devices. AMOLED displays have advantages on energy efficiency, thinness, high contrast ratio and overall display quality. Typically, an AMOLED display includes a plurality of OLEDs that are integrated with thin-film transistors (TFT) to form an OLED pixel arrays. The TFTs in the AMOLED display are fabricated with semiconductor material, but the fabrication process may generate non-uniformity throughout the OLED pixels. As a result, display defects such as mura effect (spots or clouding) are visualized in the AMOLED display, thereby reducing the satisfaction with the display.

Therefore, it would be desirable to remedy the influences of the non-uniformity and mura effect to a display apparatus, thereby improving quality of the display apparatus and improving user experience in using the display apparatus.

Nothing herein should be construed as an admission of knowledge in the prior art of any portion of the present disclosure.

SUMMARY

A display driver, a display apparatus, and an operative method thereof are introduced to remedy Mura effect and non-uniformity in a display panel.

The display driver which is coupled to the display panel to drive the display panel includes a power circuit. The power circuit supplies a first voltage and a second voltage to the display panel to sense a plurality of sensing currents flowing through the display panel according to the first voltage and the second voltage in a first operating mode. In the first operating mode, the display driver receives the plurality of sensing currents and a target current from the display panel; a plurality of offsets are determined according to the plurality of sensing currents and the target current in the; and the plurality of offsets are stored in an external memory.

The display apparatus includes a display panel having a plurality of pixels, a display driver, a controller and an external memory. The display driver is coupled to the display panel and the display driver includes a power circuit. The power circuit supplies a first voltage and a second voltage to the display panel to sense a plurality of sensing currents flowing through the display panel according to the first voltage and the second voltage in a first operating mode, wherein the display driver receives the plurality of sensing currents and a target current from the display panel. The controller is coupled to the display driver and is configured to determine a plurality of offsets according to the plurality of sensing currents and the target current in the first operating mode. The external memory is coupled to the controller and the display driver and is configured to store the offsets in the first operating mode.

The operative method is adapted to a display device having a display panel. The operative method includes steps of supplying a first voltage and a second voltage to the display panel to sense a plurality of sensing currents flowing through the display panel according to the first voltage and the second voltage in a first operating mode; determining a plurality of offsets according to the plurality of sensing currents and a target current in the first operating mode; and storing the plurality of offsets in an external memory in the first operating mode.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

FIG. 7A, FIG. 7B and FIG. 7C illustrate examples of current-gamma curves for different colors.

DESCRIPTION OF THE EMBODIMENTS

It is to be understood that other embodiments may be utilized and structural changes may be made without departing from the scope of the present disclosure. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings.

Figure 1:
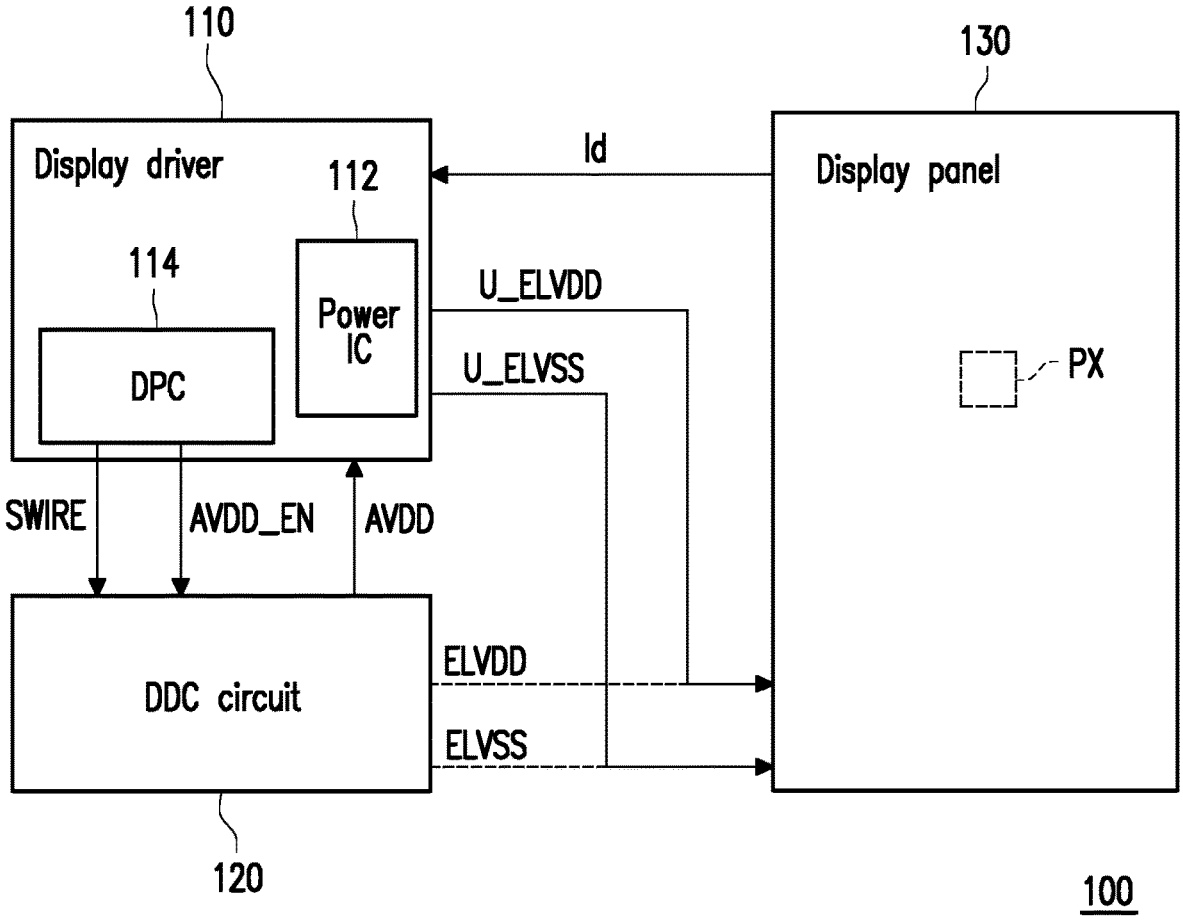
FIG. 1 illustrates a schematic diagram of a display apparatus according to an embodiment of the present disclosure.

Referring to FIG. 1, a display apparatus 100 includes a display driver 110, a direct-current to direct-current converter (DDC) circuit 120 and a display panel 130. The display driver 110 may include a power integrated circuit (IC) 112 which is configured to supply power voltages U_ELVDD and U_ELVSS to the display panel in a self-testing mode (also referred to as a first operating mode). The display driver 110 may further include a driver power controller (DPC) 114 which is coupled to the DDC circuit 120 and configured to control the DDC circuit 120 according to a power control signal (SWIRE signal or Single-WIRE signal) and an analog power enable signal AVDD_EN. The DPC 114 may communicate with the DDC 120 according to the SWIRE protocol via the SWIRE signal. The DDC 120 may supply an analog power AVDD to the display driver 110 according to the SWIRE signal and the AVDD_EN signal.

The DDC 120 may also supply the power voltages ELVDD (also referred to as a third voltage) and ELVSS (also referred to as a fourth voltage) to the display panel in a normal mode (also refer to as second operating mode). The self-testing mode may be performed before the normal mode. The self-testing mode is performed with the power voltages U_ELVDD and U_ELVSS supplied by the display driver 110 and the normal mode is performed with the power voltages ELVDD and ELVSS supplied by the DDC circuit 120. The power voltages ELVDD and ELVSS may be different from the power voltages U_ELVDD and U_ELVSS, respectively.

The display panel 130 is coupled to the display driver 110 and the DDC circuit 120 to receive the power voltages U_ELVDD and U_ELVSS from the display driver 110 in the self-testing mode, and to receive the power voltages ELVDD and ELVSS from the DDC 120 in the normal mode. When the power voltages U_ELVDD and U_ELVSS are provided to the display panel 130, the display panel 130 may output sensing currents Id to the display driver 130. The sensing currents Id are the currents measured on the pixels when the power voltages U_ELVDD and U_ELVSS are applied to the pixels. The display panel 130 may include a plurality of pixels PX arranged in a pixel array. In an embodiment of the present disclosure, the display panel 130 is a AMOLED display panel, and each of the pixels PX is an OLED pixel. However, any type of display panel may fall within the scope of the present disclosure.

Figure 2A:
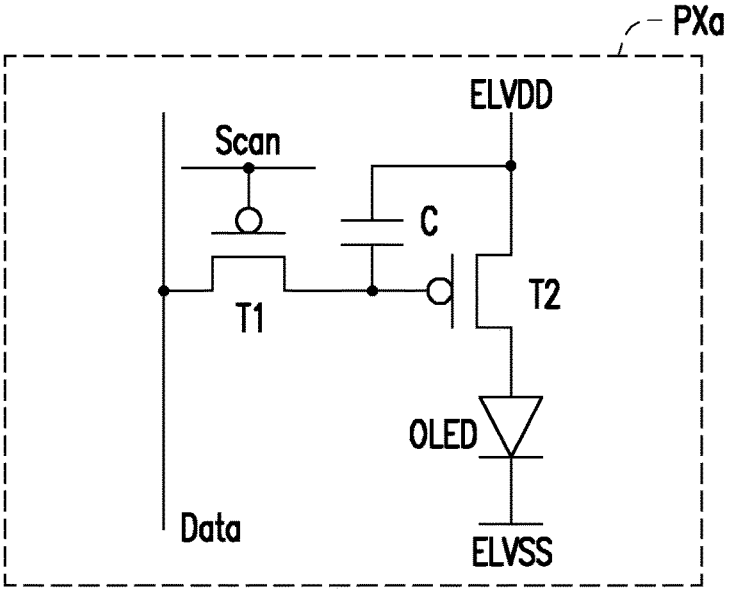
FIG. 2A and FIG. 2B illustrate a schematic circuit structure of a pixel of a display apparatus according to embodiments of the present disclosure.
Figure 2B:
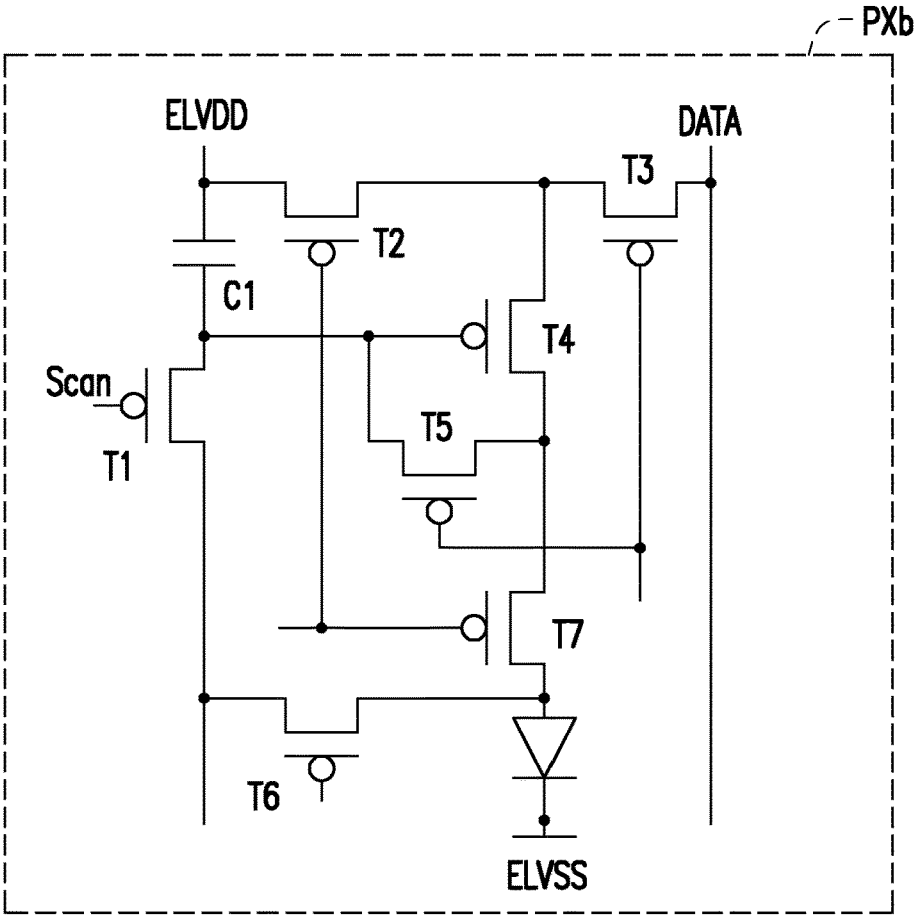

FIG. 2A and FIG. 2B illustrate different schematic circuit structures of a pixel PX according to different embodiments of the present disclosure. In FIG. 2A, each of the OLED pixel PXa may include two TFTs T1 and T2 and one capacitor C (also referred to as "2T1C" OLED pixel). The LED pixel PXa receive the scan signal at the gate terminal of T1 and the drive data signal at the source terminal of T1, so that the OLED may be controlled according to the scan signal and the drive data signal. Although the TFTs T1 and T2 illustrated in FIG. 2A are p-type TFT, but the disclosure should not be limited thereto. N-type TFTs may also be used for T1 and T2 with slight modification in the circuit design.

FIG. 2B illustrates an OLED pixel PXb which includes seven TFTs T1 to T7 and one capacitor C1. The scan signal and the data signal are also provided to the OLED pixel PXb so as to control the operation of the OLED pixel PXb according to the scan signal and the data signal. It should be noted that the type of the TFTs T1 to T7 and the type of the capacitor C1 are not limited in the present disclosure.

Figure 3:
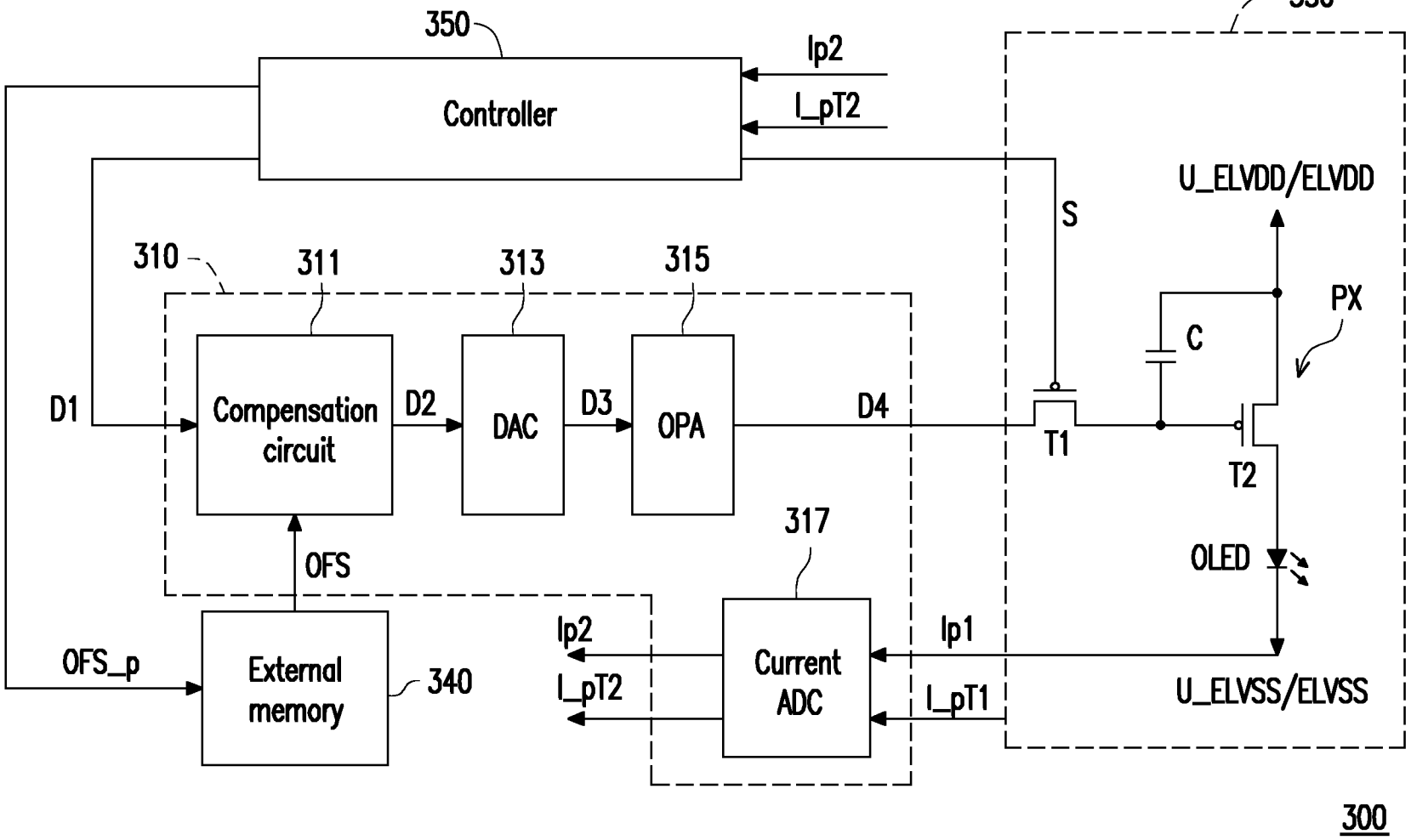
FIG. 3 illustrates schematic diagram of a pixel-based display apparatus according to an embodiment of the present disclosure.

FIG. 3 illustrates a display apparatus 300 which includes a display driver 310, a display panel 330, an external memory 340 and a controller 350. The display driver 310 includes a compensation circuit 311, a digital-to-analog converter (DAC) 313, an operation amplifier (OPA) 315, and a current analog-to-digital converter (ADC) 317. The compensation circuit 310 is coupled to the controller 350 and the external memory 340 to receive the drive data D1 from the controller 350 and the offsets OFS from the external memory. The compensation circuit 311 is configured to compensate the drive data D1 with the offsets OFS to generate the data D2. The DAC 313 is coupled to the compensation circuit 311 to receive the data D2 and convert the data D2 to analog data D3. The analog data D3 are amplified by the OPA 315 to generate compensated drive data D4 which are used to drive the display panel 330.

The current ADC 317 may receive a sensing current Ip1 (pixel-based sensing current) which is a current flowing through the OLED when the power voltages U_ELVDD and U_ELVSS are applied to the pixel PX. The pixel-based sensing current Ip1 may be converted to the digital sensing current Ip2 by the ADC 317.

The current ADC 317 may further receive a pixel-based target current I_pT1 from the display panel 330, and then converts the target current I_pT1 to digital target current I_pT2. In an embodiment of the present disclosure, the pixel-based target current I_pT1 may be the current flowing through a center pixel when the power voltages U_ELVDD and U_ELVSS are applied to the center pixel. The center pixel is located at a central region of the display panel 330. The pixel-based target current I_pT1 may also be a predetermined value in another embodiment of the present disclosure.

The controller 350 is coupled to the ADC 317 to receive the sensing current Ip2 and the target current I_pT2 from the ADC 317. The controller 350 may generate the pixel-based offset OFS_p for the pixel PX according to the sensing current Ip2 and the target current I_pT2. In analogy, the controller 350 may generate the pixel-based offset OFS_p for each of the pixels in the display panel 330 according to the corresponding sensing current and the target current I_pT2. The external memory 340 is coupled to the controller 350 to receive and store the offsets corresponding to the pixels of the display panel 330. The memory 340 may be a flash memory, but the disclosure is not limited thereto.

Figure 4:
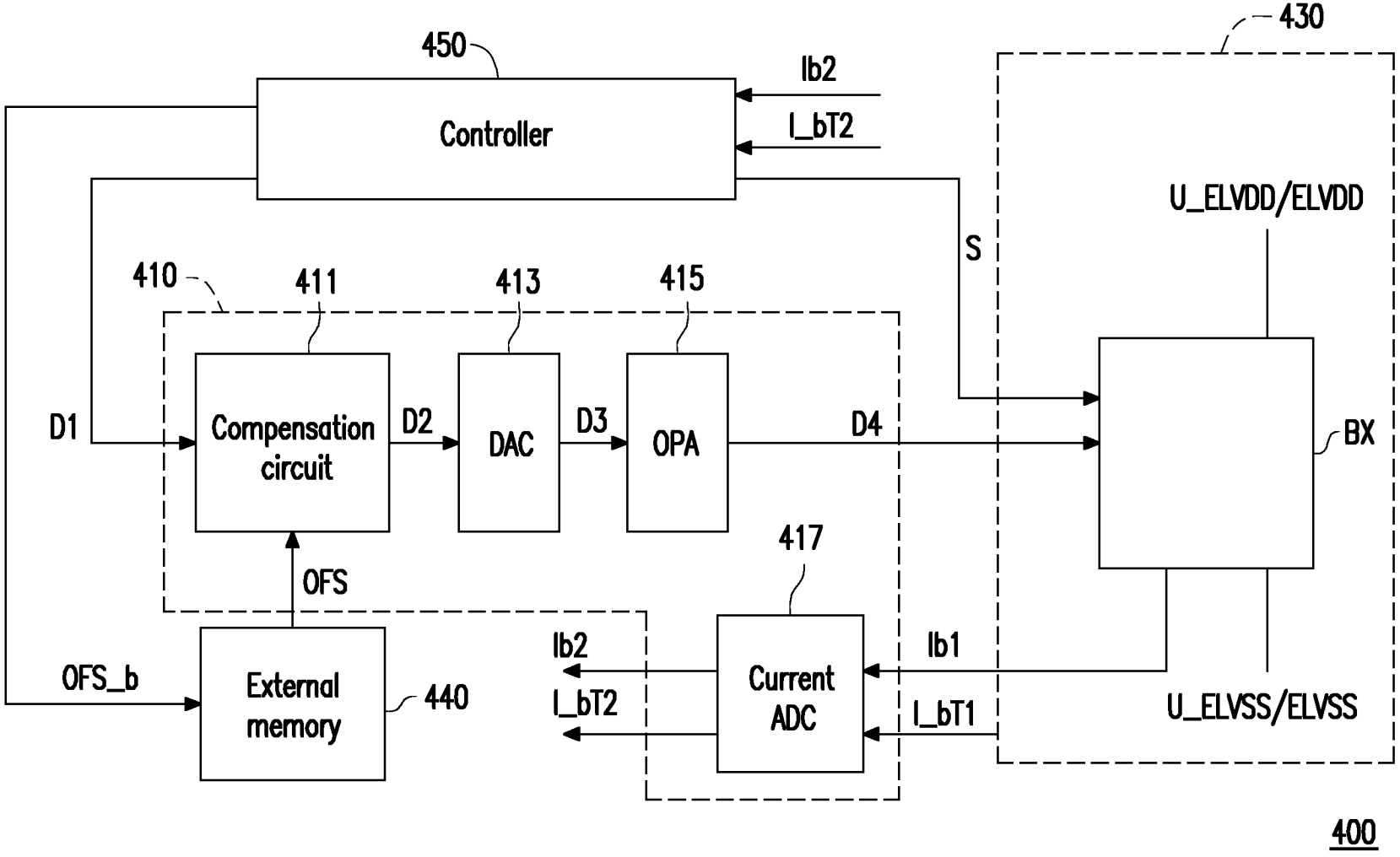
FIG. 4 illustrates schematic diagram of a block-based display apparatus according to an embodiment of the present disclosure.

FIG. 4 illustrates a display apparatus 400 which includes a display driver 410, a display panel 430, an external memory 440 and a controller 450. The display driver 410, the external memory 440 and the controller 450 are similar to the display driver 310, the external memory 340 and the controller 350, thus the detailed description of these components are omitted herein.

The display panel 430 includes a plurality of pixels which are divided into a plurality of blocks BX. In the self-testing mode, the block BX receives the power voltages U_ELVDD and U_ELVSS from the display driver 410; and a block-based sensing current Ib1 corresponding to the block BX is output to the current ADC 417 of the display driver 410. The block-based sensing current Ib1 is the current flowing through the block BX when the power voltages U_ELVDD and U_ELVSS are applied to the block BX. In an example, the block-based sensing current Ib1 may be the sum of the currents flowing through the pixels of the block BX. In another example, the block-based sensing current Ib1 may be an average of the currents flowing through the pixels of the block BX. The block-based sensing current Ib1 corresponds to the block BX, and the disclosure is not limited to any specific way to obtain the sensing current Ib1.

In addition to the block-based sensing current Ib1, the display panel 410 may further provide a block-based target current I_bT1 to the display driver 410. The block-based target current I_bT1 may be the current flowing through a center block when the power voltages U_ELVDD and U_ELVSS are applied to the center block. The center block is located at a central region of the display panel 430. In another embodiment, the block-based target current I_bT1 may be a pre-determined target current.

The ADC 417 receives the block-based sensing current Ib1 and the block-based target current I_bT1, and converts the currents Ib1 and I_bT1 to digital block-based sensing current Ib2 and digital block-based target current I_bT2, respectively. The controller 450 receives the currents Ib2 and I_bT2 and generates a block-based offset OFS_b for the block BX according to the currents Ib2 and I_bT2. The block-based offset OFS_b for the block BX is stored in the external memory 440 and is used to compensate the drive data in the normal mode. Similarly, the block-based offset for each of the blocks of the display panel 430 are determined and stored in the external memory 440.

Figure 5:
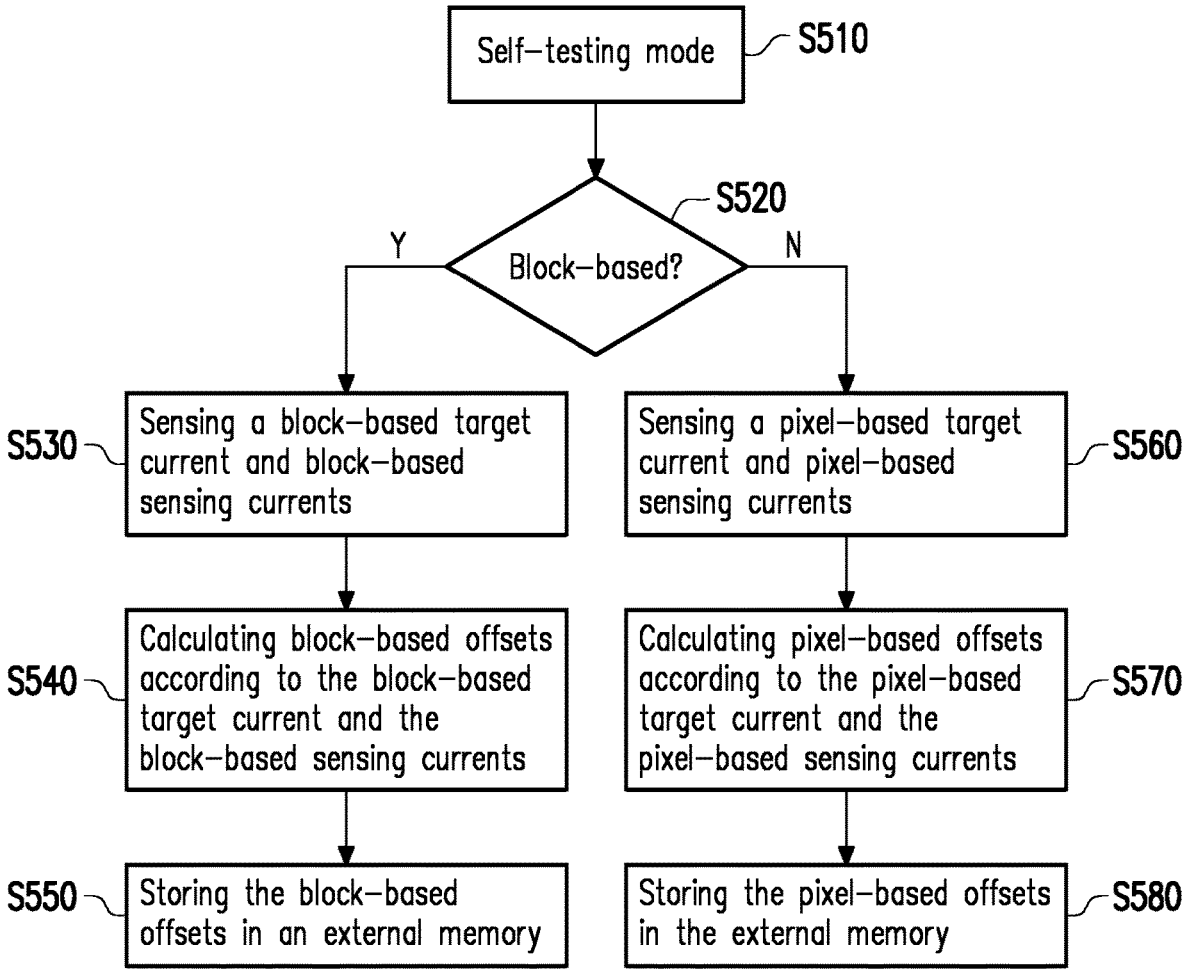
FIG. 5 illustrates a flowchart diagram of a display apparatus operating in a self-testing mode according to an embodiment of the present disclosure.

Referring to FIG. 5, when the display apparatus is operated in the self-testing mode (step S510), whether a block-based compensation or pixel-based compensation is determined (step S520). When the block-based compensation is selected, a block-based target current and a plurality of block-based sensing currents corresponding to blocks of the displayed panel are sensed (step S530). In step S540, the block-based offsets are calculated according to the block-based sensing currents and the block-based target current. In step S550, the block-based offsets for the blocks of the display panel are stored in the external flash memory so as to be used in the normal mode.

If the pixel-based compensation is selected in step S520, in steps S560 to steps S570, a pixel-based target current and the plurality of pixel-based sensing currents are sensed; and the pixel-based offsets for each of the pixels are calculated according to the pixel-based sensing currents and the pixel-based target current. In steps S580, the pixel-based offsets for the pixels are stored in the external memory so as to be used in the normal mode.

Figure 6:
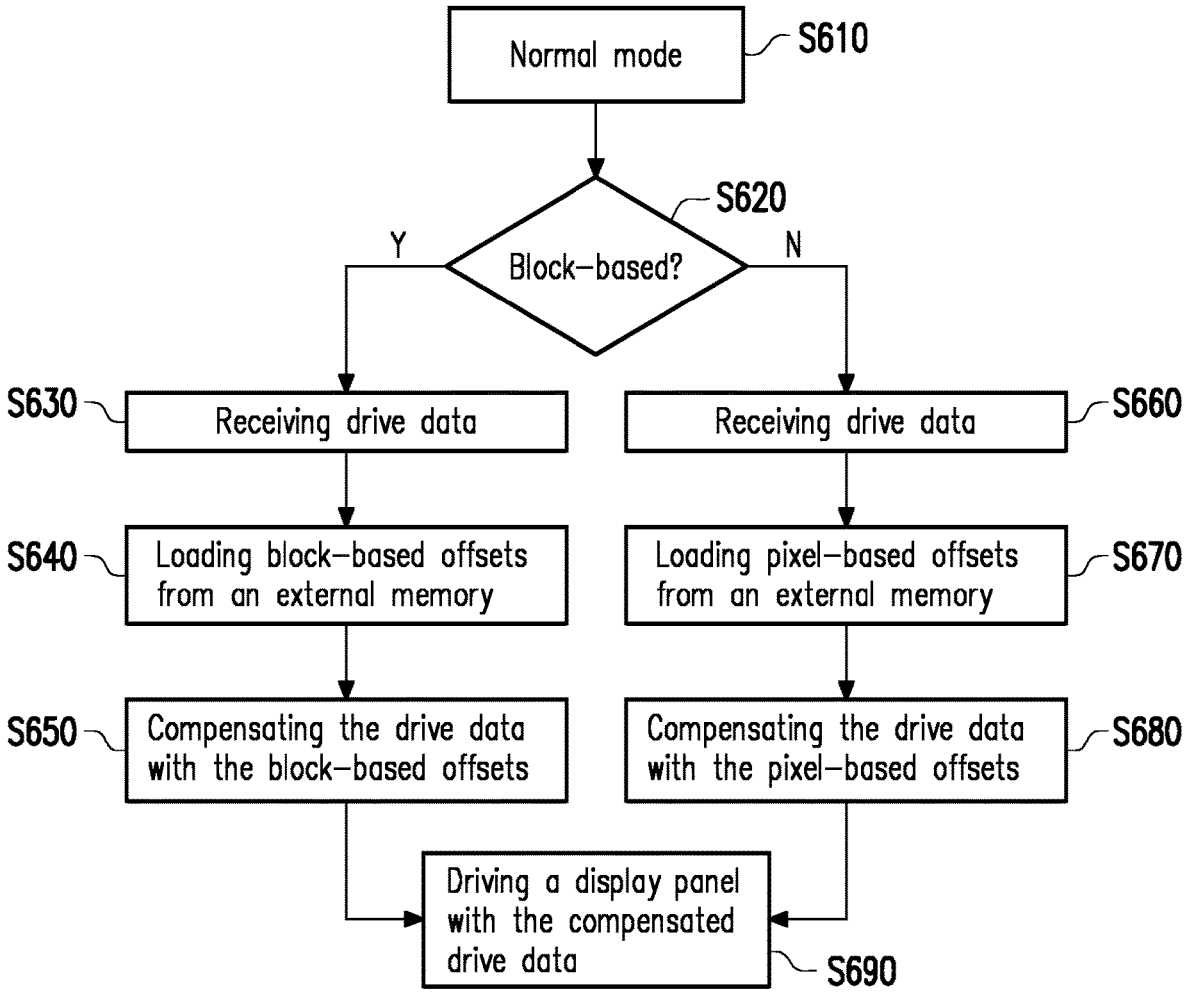
FIG. 6 illustrates a flowchart diagram of a display apparatus operating in a normal mode according to an embodiment of the present disclosure.

Referring to FIG. 6, when the display apparatus is operating in a normal mode (step S610), whether a block-based compensation or a pixel-based compensation are selected in step S620. In steps S630 and S640, the drive data are received and the block-based offset are loaded from the external memory. In steps S650 and S690, the drive data are compensated with the block-based offsets to generate compensated drive data which are used to drive the display panel.

If the pixel-based is selected in step S620, the drive data are received and the pixel-based offsets are loaded from the external memory in steps S660 and S670. In step S680, the drive data are compensated with the pixel-based offsets to generate compensated drive data. The compensated drive data are used to drive the display panel in step S690.

In an embodiment of the present disclosure, the offsets may include current offsets and gamma-code offsets, where the gamma-code offsets may be determined according to the current offsets based on at least one current-gamma curves. FIG. 7A to FIG. 7C shows examples of block-based current-gamma curves that may be used to determine the gamma offsets according to the current offsets and vice versa. Referring to FIG. 7A, the current-gamma curve for red color is shown, where a current offset for red color may be used to determine the corresponding gamma offset or gamma code. Similarly, the current-gamma curves for green and blue colors are shown in FIG. 7B and FIG. 7C, and the corresponding gamma offset or gamma code for green and blue colors may be determined according to the current offsets for green and blue colors, respectively. The current-gamma curves in FIG. 7A to FIG. 7C are the block-based current-gamma curves, and the current-gamma curves for pixel-based offsets could be deduced similarly.

Figure 8:
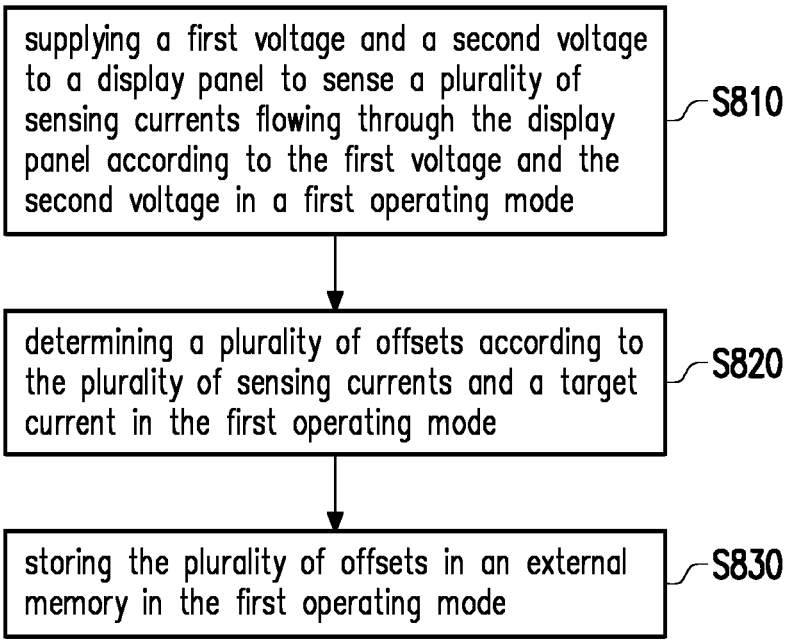
FIG. 8 illustrates an operative method according to an embodiment of the present disclosure.

FIG. 8 illustrates an operative method adapted to a display device having a display panel according to an embodiment of the present disclosure. In step S810, a first voltage (U_ELVDD) and a second voltage (U_ELVSS) are supplied to the display panel to sense a plurality of sensing currents flowing through the display panel according to the first voltage and the second voltage in a first operating mode (e.g., self-testing mode). In steps S820, it determines a plurality of offsets according to the plurality of sensing currents and a target current in the first operating mode. In steps S830, the plurality of offsets are stored in an external memory in the first operating mode. The plurality of offsets stored in the external memory may be used in the second operating mode (e.g., normal mode) to compensate the drive data with the plurality of the offsets so as to generate accurate drive data.

From the above embodiments, first and second voltages from a display driver are provided to the display panel in a first operating mode (e.g., self-testing mode) to generate a plurality of offsets (e.g., current offsets and/or gamma offsets). The plurality of offsets are stored in an external memory (e.g., external flash memory), and the plurality of offsets are loaded in a second operation mode (e.g., normal mode) to compensate the drive data. Since the offsets are generated by the first and the second voltages provided by the display driver, no additional circuit is required for generating the offsets. By compensating the offsets stored in the external memory with the drive data, the display defects caused by non-uniformity and Mura effect may be effectively remedied. In addition, the display driver and the display apparatus in the present disclosure may generate block-based offsets in the first mode to compensate block-based drive data in the second mode. As such, the processing time of the first mode and second mode are faster, thereby improving the quality and performance of the display apparatus.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. An operative method adapted to a display device having a display panel, the method comprising:

supplying a first voltage and a second voltage to the display panel to sense a plurality of sensing currents flowing through the display panel according to the first voltage and the second voltage in a first operating mode;

determining a plurality of offsets according to the plurality of sensing currents and a target current in the first operating mode;

storing the plurality of offsets in an external memory in the first operating mode;

loading the plurality of offsets from the external memory and receiving drive data in a second operating mode;

compensating the drive data with the plurality of offsets to obtain compensated data in the second operating mode;

driving the display panel with the compensated drive data in the second operating mode, wherein the second operating mode is different from the first operating mode; and supplying a third voltage and a fourth voltage to the display panel in the second operating mode, wherein the third voltage is different from the first voltage, and the fourth voltage is different from the second voltage.

2. The operative method of claim 1, further comprising:

receiving the plurality of sensing currents and the target current from the display panel from the display panel, wherein the step of determining the plurality of offsets according to the plurality of sensing currents and the target current comprises:

comparing the target current with each of the sensing currents to obtain the plurality of offsets.

3. The operative method of claim 1, wherein the display panel comprises a plurality of pixels arranged in blocks, the plurality of sensing currents are block-based sensing currents, where each of the block-based sensing currents is a current flowing through one of the blocks when the first voltage and the second voltage are applied to the one of the blocks, and the target current is a block-based target current.

4. The operative method of claim 3, wherein the plurality of blocks comprises a center block which is located at a center region of the display panel, and the block-based target current is a current flowing through the center block when the first voltage and the second voltage are applied to the center block.

5. The operative method of claim 1, wherein the display panel comprises a plurality of pixels, the plurality of sensing currents are pixel-based sensing currents, where each of the pixel-based sensing currents is a current flowing through one of the pixels when the first voltage and the second voltage are applied to the one of the pixels, and the target current is a pixel-based target current.

6. The operative method of claim 5, wherein the plurality of pixels comprises a center pixel which is located at a center region of the display panel, and the pixel-based target current is a current flowing through the center pixel when the first voltage and the second voltage are applied to the center pixel.

7. The operative method of claim 1, wherein the plurality of offsets comprises a plurality of current offsets and a plurality of gamma-code offsets, and the plurality of gamma-code offsets are determined according to the plurality of current offsets based on at least one predetermined current-gamma curve.

8. The operative method of claim 7, wherein the at least one predetermined current-gamma curve comprises a first current-gamma curve corresponding to a red color, a second current-gamma curve corresponding to a green color, and a third current-gamma curve corresponding to a blue color.

9. A display driver coupled to a display panel to drive the display panel, comprising:

a power circuit, supplying a first voltage and a second voltage to the display panel to sense a plurality of sensing currents flowing through the display panel according to the first voltage and the second voltage in a first operating mode, wherein the display driver receives the plurality of sensing currents and a target current from the display panel in the first operating mode, a plurality of offsets are determined according to the plurality of sensing currents and the target current in the first operating mode, and the plurality of offsets are stored in an external memory in the first operating mode; and a compensation circuit, loading the plurality of offsets from the external memory, receiving drive data, and compensating the drive data with the plurality of offsets to generate a compensated data in a second operating mode, wherein the compensated data are used to drive the display panel in the second operating mode, a third voltage and a forth voltage are supplied to the display panel in the second operating mode, the third voltage is different form the first voltage and the fourth voltage is different from the second voltage.

10. The display driver of claim 9, further comprising:

a current analog-to-digital converter (ADC), receiving the plurality of sensing currents and the target current, and converting the plurality of sensing currents and the target current to a plurality of digital sensing currents and a digital target current in the first operating mode, wherein the plurality of offsets are determined according to the plurality of digital sensing currents and the digital target current.

11. The display driver of claim 9, wherein the display panel comprises the plurality of pixels arranged in blocks, the plurality of sensing currents are block-based sensing currents, where each of the block-based sensing currents is a current flowing through one of the blocks when the first voltage and the second voltage are applied to the one of the blocks, and the target current is a current flowing through a center block when the first voltage and the second voltage are applied to the center block, wherein the center block is located at the center region of the display panel.

12. The display driver of claim 9, wherein the display panel comprises a plurality of pixels, the plurality of sensing currents are pixel-based sensing currents, where each of the pixel-based sensing currents is a current flowing through one of the pixels when the first voltage and the second voltage are applied to the one of the pixels, and the target current is a current flowing through a center pixel when the first voltage and the second voltage are applied to the center pixel, wherein the center pixel is located at a center region of the display panel.

13. A display apparatus, comprising:

a display panel, having a plurality of pixels;

a display driver, coupled to the display panel, comprising:

a power circuit, supplying a first voltage and a second voltage to the display panel to sense a plurality of sensing currents flowing through the display panel according to the first voltage and the second voltage in a first operating mode, wherein the display driver receives the plurality of sensing currents and a target current from the display panel;

a controller, coupled to the display driver, determining a plurality of offsets according to the plurality of sensing currents and the target current in the first operating mode;

an external memory, coupled to the controller and the display driver, storing the offsets in the first operating mode; and a compensation circuit, loading the plurality of offsets from the external memory, receiving drive data, and compensating the drive data with the plurality of offsets to generate a compensated data in the second operating mode, wherein the compensated data are used to drive the display panel in the second operating mode; and a direct-current to direct-current (DDC) converter circuit, coupled to the display panel, supplying a third voltage and a fourth voltage to the display panel in a second operating mode, wherein the third voltage is different from the first voltage and the fourth voltage is different from the second voltage.

14. The display apparatus of claim 13, wherein the display driver further comprises:

a current analog-to-digital converter (ADC), receiving the plurality of sensing currents and the target current, and converting the plurality of sensing currents and the target current to a plurality of digital sensing currents and a digital target current in the first operating mode, wherein the controller determines the plurality of offsets according to the plurality of digital sensing currents and the digital target current.

15. The display apparatus of claim 13, wherein the plurality of pixels arranged in blocks, the plurality of sensing currents are block-based sensing currents, where each of the block-based sensing currents is a current flowing through one of the blocks when the first voltage and the second voltage are applied to the one of the blocks, and the target current is a current flowing through a center block when the first voltage and the second voltage are applied to the center block, wherein the center block is located at a center region of the display panel.

16. The display apparatus of claim 13, wherein the plurality of sensing currents are pixel-based sensing currents, where each of the pixel-based sensing currents is a current flowing through one of the pixels when the first voltage and the second voltage are applied to the one of the pixels, and the target current is a current flowing through a center pixel when the first voltage and the second voltage are applied to the center pixel, wherein the center pixel which is located at a center region of the display panel.

17. An operative method adapted to a display device having a display panel, the method comprising:

supplying a first voltage and a second voltage to the display panel to sense a plurality of sensing currents flowing through the display panel according to the first voltage and the second voltage in a first operating mode;

determining a plurality of offsets according to the plurality of sensing currents and a target current in the first operating mode, and storing the plurality of offsets in an external memory in the first operating mode, wherein the plurality of offsets comprises a plurality of current offsets and a plurality of gamma-code offsets, and the plurality of gamma-code offsets are determined according to the plurality of current offsets based on at least one predetermined current-gamma curve.

* * * * *